US005809907A

United States Patent [19]

Bumgarner

[11] Patent Number: 5,809,907

[45] Date of Patent: Sep. 22, 1998

[54] PALLET ASSEMBLY

[75] Inventor: Tim Bumgarner, Mission Viejo, Calif.

[73] Assignee: Timothy R. Bumgarner, Mission Viejo, Calif.

[21] Appl. No.: 738,420

[22] Filed: Oct. 25, 1996

[51] Int. Cl.[6] ..... B65D 19/00

[52] U.S. Cl. ..... 108/51.11; 108/57.17; 108/57.32; 52/223.8

[58] Field of Search ..... 108/51.1, 51.11, 108/56.1, 57.17, 57.31, 57.32, 57.33; 52/223.1, 223.6, 223.8, 223.12, 223.11, 223.14

[56] References Cited

U.S. PATENT DOCUMENTS

| | | | |
|---|---|---|---|
| 1,698,038 | 1/1929 | Warshaw et al. | 108/51.1 |
| 2,492,626 | 12/1949 | Fletcher | 108/51.1 |
| 2,720,323 | 10/1955 | Hoiles | 108/51.1 X |
| 3,882,651 | 5/1975 | Gilchrist | 52/223.6 |
| 4,060,037 | 11/1977 | Gustafsson | 108/51.1 |
| 5,042,396 | 8/1991 | Shuert | 108/51.1 |
| 5,415,109 | 5/1995 | McBride | 108/51.1 |

FOREIGN PATENT DOCUMENTS

| | | | |
|---|---|---|---|
| 561148 | 7/1958 | Canada | 108/51.1 |
| 1050723 | 9/1953 | France | 108/51.1 |
| 772100 | 4/1957 | United Kingdom | 108/51.1 |
| 1454882 | 11/1976 | United Kingdom | 108/51.1 |

*Primary Examiner*—Peter M. Cuomo
*Assistant Examiner*—Janet M. Wilkens
*Attorney, Agent, or Firm*—Richard L. Myers

[57] ABSTRACT

A pallet having a top section and trusses which form support members in a bottom section is disclosed. The trusses can facilitate maintenance of a pre-load in the top section of the pallet. The trusses extend from the top section to a supporting surface upon which the pallet rests. Leading edges of the trusses can be curved in order to provide the pallet with skis. The curved leading edges facilitate movement of the pallet along the supporting surface.

9 Claims, 4 Drawing Sheets

PALLET ASSEMBLY

BACKGROUND OF THE INVENTION

1. Field of the Invention

This invention relates generally to pallets and more specifically pallets formed of metal materials.

2. Discussion of the Prior Art

Pallets have long been relied upon to support heavy loads at a predetermined height above a supporting surface. These pallets typically have a top section providing a major surface for receiving the load, and a bottom section which supports the top section above the supporting surface. The bottom section is commonly configured to facilitate accessing the pallet with a fork lift which can then lift the pallet and its load for transport to a different location.

In U.S. patent application Ser. No. 08/404,903 filed on Mar. 15, 1995 and entitled, Modular Metal Pallet, which is incorporated herein by reference, applicant teaches that such a pallet can be constructed of tubular steel and provided with a pre-load. Forming the bottom section of the pallet in a manner so as to facilitate maintenance of the pre-load in the top section is always of interest in pallet design. Although the use of the trusses to maintain a pre-load has been discussed, there has been no contemplation of the use of trusses to form the supports in the bottom section.

It is also desirable to provide pallets with a structure which can facilitate movement of the pallet along the supporting surface, such as a roller assembly. In spite of this need, there has been no contemplation of providing the supports with a sloped leading surface in order that the supports might function as a plurality of skis.

Where supports have been used in the bottom section of the pallet, cross members have been used to add structural rigidity. However, these cross members have only been formed with abrupt surfaces which inhibit the movement of fork lifts into the bottom section. More specifically, hand fork lifts (which are provided with rollers beneath the fork blades) have been difficult to use with these pallets, and when used have tended to severely damage the pallets.

Pallets have also been provided with coatings such as paint, but no attempt has been made to increase the coefficient of friction between the pallet and its load by providing a high friction coating. Applying such a coating to all surfaces of the pallet in order to also inhibit corrosion, has not been contemplated by the prior art.

SUMMARY OF THE INVENTION

These deficiencies of the prior art are overcome in accordance with the present invention which includes a pallet having a top section and trusses which form support members in a bottom section. These trusses can be adapted to facilitate maintenance of the pre-load in the top section of the pallet. The trusses which extend from the top section to the supporting surface can be configured to form a sloping leading edge in order to provided the pallet with skis. This greatly facilitates movement of the pallet along the supporting surface, such as a series of rollers, without damage to the pallet.

The pallet can be provided with cross members which connect the supports in the bottom section of the pallet. These cross members can be formed to facilitate use with hand fork lifts and structurally configured to inhibit damage to the pallet.

A coating can be provided on the pallet, for example, by spraying. Forming this coating from a material having a coefficient of friction with the load which is higher than the coefficient of friction between tubular steel and the load, tends to maintain the load on the pallet. Applying such a material to substantially all of the surfaces of the pallet inhibits corrosion and thereby extends the useful life of the pallet.

In one aspect of the invention, the pallet is adapted to maintain the load at a predetermined height above a supporting surface and includes a top section having a first major surface for receiving the load and a second major surface. This top section is stressed to provide the pallet with a pre-load. A bottom section connected to the top section extends between the second major surface of the top section and the supporting surface. A plurality of trusses included in the bottom section are also stressed to provide the trusses with a pre-load.

In another aspect of the invention, the bottom section is connected to the top section and has properties for maintaining at least a portion of the pre-load in the top section. A plurality of supports included in the bottom section each extends between the second major surface of the top section and the supporting surface. At least one of the supports is formed of tubular steel and has a leading edge bent to form a ski which facilitates sliding movement of the pallet on the supporting surface.

In further aspect of the invention, the plurality of supports in the bottom section are connected by at least one cross member having a bottom wall with a width extending longitudinally between a first edge and a second edge. A side wall is connected to the bottom wall along the first edge. This edge is provided with a radius which has a ratio with a width of the bottom wall which is not less than 1/20.

These and other features and advantages of the invention will be better understood with a description of the preferred embodiments of the invention and referenced to the associated drawings.

DESCRIPTION OF PREFERRED EMBODIMENTS AND BEST MODE OF THE INVENTION

Figure 1:
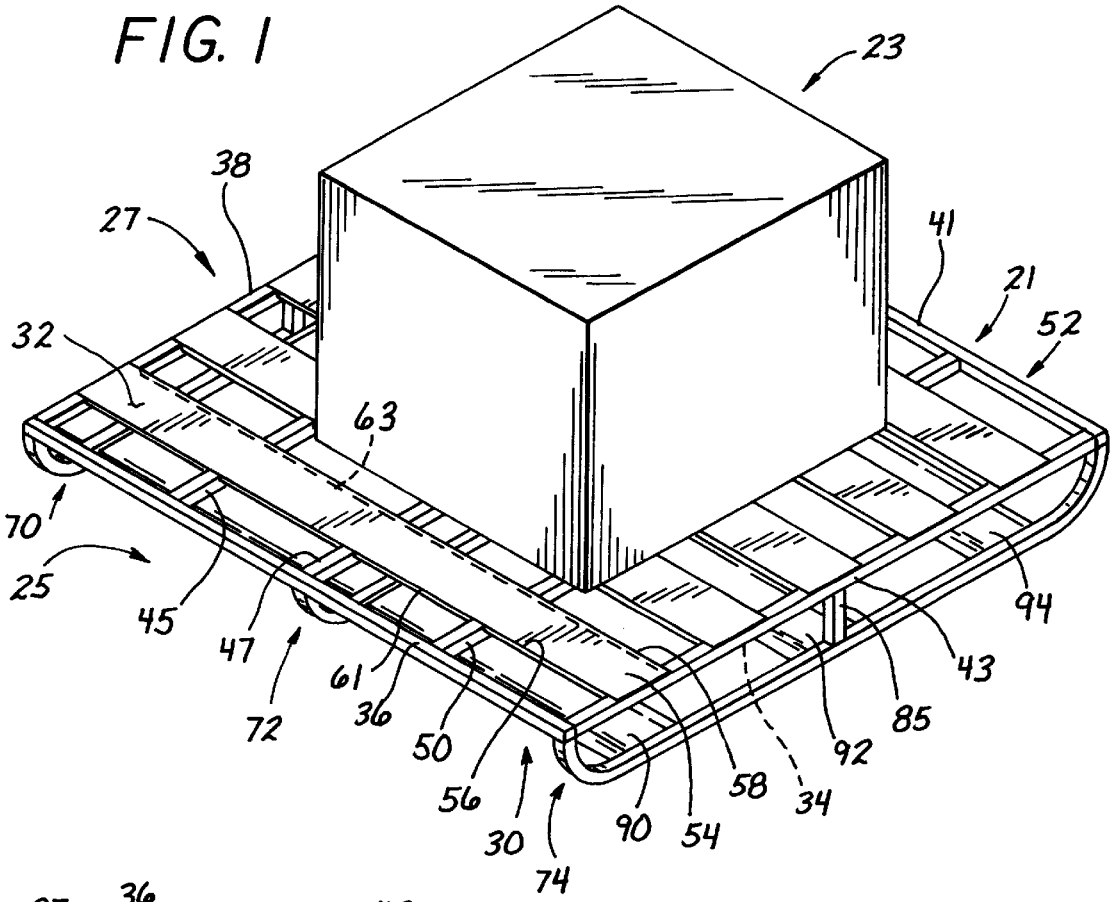
FIG. 1 is a perspective view of one embodiment of the pallet of the present invention with a load supported at a predetermined height above a supporting surface.

A pallet is illustrated in FIG. 1 and designated generally by the reference numeral 21. The pallet 21 is adapted to support a load 23 at a predetermined height above a supporting surface 25. The pallet 21 includes a top section 27 and a bottom section 30. The top section 27 has a generally planar configuration with a top surface 32 which faces outwardly of the pallet 21, and a bottom surface 34 which faces inwardly of the pallet 21. When operatively disposed on the supporting surface 25, the load 23 is in contact with the top surface 32.

The top section 27 can have generally any form as long as it is sufficiently strong to support the load 23. In a preferred embodiment, the top section 27 is formed from metal and has properties for being stressed in order to pre-load the top section 27. In the illustrated embodiment, the top section 27 is formed primarily of tubular steel which provides a significant strength to weight ratio which is particularly advantageous in a preferred embodiment. The tubular steel can include perimeter members 36, 38, 41 and 43 which are joined at their ends to provide the top surface 32 with a generally rectangular configuration. Extending between the perimeter members 36 and 41 are a plurality of intermediate members designated by the reference numerals 45, 47 and 50. All of the tubular steel members 36, 38, 41, 43, 45, 47, 50 are welded at their ends to form a skeleton or frame 52 for the top section 27.

In order to increase the area of the surface 32 and add structural rigidity to the pallet 21, a slat 54 can be positioned transverse to the perimeter members 38 and 43 as well as the intermediate 45, 47, 50. This slat 54 is representative of five slats illustrated in FIG. 1 to have a generally parallel configuration.

The slat 54 is preferably formed from sheet steel and extends longitudinally between a pair of edges 56 and 58. At each of the edges 56 and 58, and edge flange 61 and 63, respectively, is provided in order to strengthen the associated slat 54. These edges flanges 61, 63, which preferably face into the pallet 21, are interrupted to receive the perimeter members 38, 43 and the intermediate members 45, 47, 50. This permits the slat 54 to lie flat on the frame 52 where at least it partially defines the top surface 32.

The structural rigidity provided by the tubular steel members, the slat 54, and the associated edge flanges 61, 63 can be particularly appreciated in this embodiment of the invention. With these members being formed of metal, they can be joined by welding in order to further strengthen the resulting top section 27. In the matter taught by applicant in U.S. patent application Ser. No. 08/404,903, this top section 27 can be pre-loaded to greatly increase the load carrying capacity of the pallet 21.

Of particular interest to the present invention is the bottom section 50 which includes three support assemblies 70, 72 and 74. Although, three assemblies 70, 72, 74 are illustrated in FIG. 1, it will be apparent that any plurality of support assemblies would be appropriate to the present invention. In this particular embodiment, the support assemblies 70, 72, 74 are also formed of tubular steel. In a preferred embodiment, this tubular steel has a cross section that is approximately one inch square.

Each of the support assemblies, such as the assembly 74, includes a single rail 76 having ends 78 and 80 which are bent in a common direction and attached to the frame 52 of the top section 27. Preferably, the support assembly 74, including the rail 76 and ends 78, 80, is disposed in a common plane 83 which extends generally perpendicular to the supporting surface 32 of the top section 27.

With the rail 76 rounded at its ends 78, 80, the support assembly 74 is provided with an inclined surface on its leading edge which enables the support assembly 74 to function as a ski. This inclined surface can take many forms although in the illustrated embodiment the inclined surface on the leading edge of the support assembly 74 forms a quarter circle. The inclined surface increases from 0 to 90 degrees relative to the supporting surface with progressive positions from the bottom surface 77 of the bottom section 30, to the bottom surface 34 of the top section 27.

In a preferred embodiment, the inclined surface at the ends 78, 81 of the rail 76 is bent on a two inch radius. This dimension enables the leading edge to bend through a full 90 degrees while maintaining the height of the truss at about four inches. Although the angle of the bend can be less than 90 degrees, the full quarter circle is desired to make the leading edge perpendicular to the top section 27 and parallel to the supporting surfaces 25. And, although a 90 degree bend could be achieved with a radius greater than two inches, this may be less desirable because it would increase the height of the support assembly 70, 72, 74 beyond the four inch height which is preferred for stackability and for operation with forklifts and conveyor systems.

With an inclined surface on the front of the rail 76, the support assembly 74 functions as a ski so that an abrupt or irregular supporting surface 25 does not inhibit movement of the pallet 21. This is particularly appreciated on conveyor belts and roller assemblies where the support assemblies 70, 72, 74 encounter discreet rollers which are easily accommodated with the ski configuration.

At least one center support 85 is provided in the bottom section 30 where it is welded between the perimeter member 43 of the top section 27 and rail 76 of the bottom section 30. In the illustrated embodiment, the single center support 85 is preferably disposed intermediate the ends 78 and 80. A center support, similar to the support 85, is provided in each of the assemblies 70, 72, 74 in the illustrated embodiment.

Figure 5:
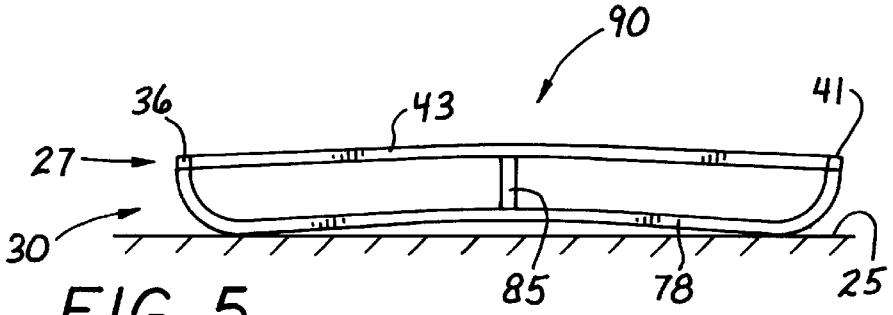
FIG. 5 is a side view similar to FIG. 2 and illustrating a pre-load in trusses associated with support members of the pallet.
Figure 6:
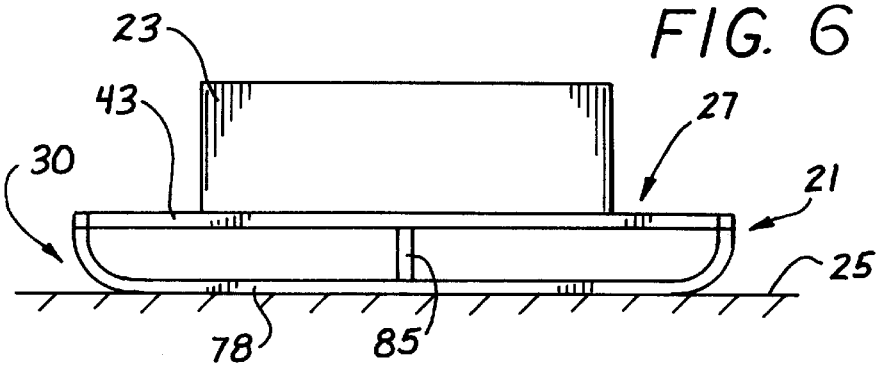
FIG. 6 is a side view similar to FIG. 2 and illustrating the pallet of FIG. 5 under load.

The resulting pallet 21 including the top section 27 and bottom section 30 can be advantageously pre-loaded in the manner previously discussed. With reference to FIG. 5, this pre-load will typically provide the unloaded pallet with a bowed shape so that the top surface 27 has a crown as illustrated in FIG. 5 and designated generally by the reference numeral 90. It is, of course, desirable to maintain this pre-load in the top section 27. One advantage of the present invention is that the support assemblies 70, 72, 74 can be formed as trusses which can also be pre-loaded in the manner illustrated in FIG. 5. Whether these support assemblies 70, 72, 74 are considered to be pre-loaded or merely supportive of the pre-load in the top section 27, they function to maintain the crown 90 on the pallet 27 until the load 23 is applied. As the load 23 is applied to the pallet 21, a portion of its weight is taken up by the pre-load and the crown 90 which are removed from both the top section 27 as well as the rail 78 in the bottom section 30 as illustrated in FIG. 6.

Figure 2:
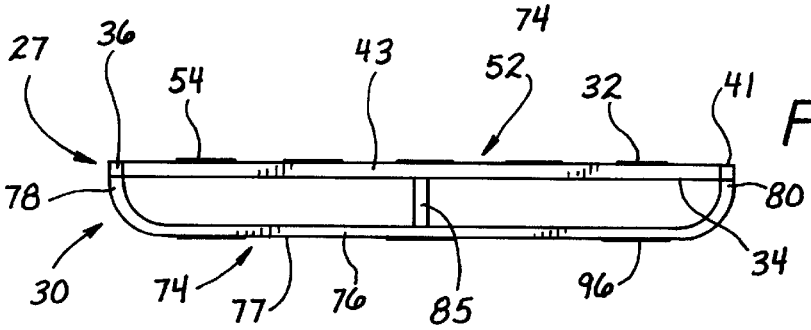
FIG. 2 is a side view of the pallet illustrated in FIG. 1.
Figure 3:
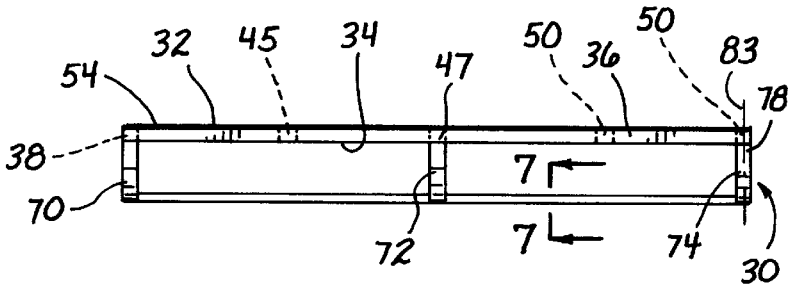
FIG. 3 is a front view of the pallet illustrated in FIG. 1.

Another feature of particular interest to the present invention involves a plurality of cross members 90, 92 and 94, three of which are illustrated in the embodiment of FIG. 1. These cross members 90, 92, 94 are included in the bottom section 30 and extend transverse to the support assemblies 70, 72, 74. In the illustrated embodiment, the cross members 90–94 extend generally perpendicular to the support assemblies 70, 72, 74 and define with the assemblies 70, 72, 74 a third major surface 96 of the pallet 21. This major surface 96, best illustrated in the side view of FIG. 2, is adapted to contact the supporting surface 25.

Figure 9:
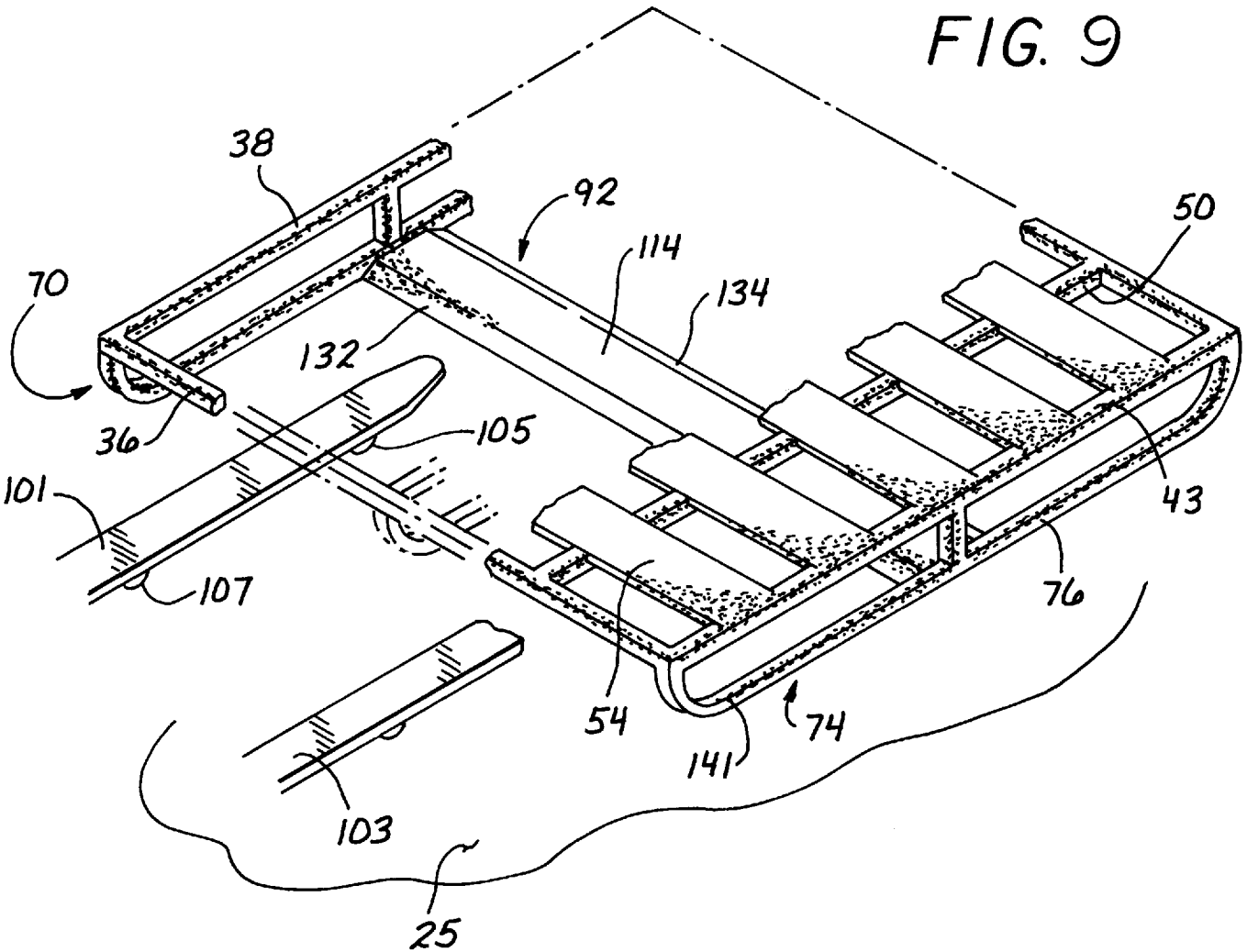
FIG. 9 is a perspective view, partially in phantom, of a further embodiment of the invention, illustrating the pallet in use with a hand fork lift.

Of course, the cross members 90, 92, 94 contribute greatly to the structural rigidity of the bottom section 30 as well as the pallet 21. Nevertheless, their contact with the supporting surface 25 can be of particular concern. Pallets, such as the pallet 21, are designed to be lifted and moved in order to transport their loads, such as the load 23, to a different location. This lifting and moving of the pallet 21 and load 23 is typically accomplished with a fork lift, such as the hand operated fork lift having two forks 101 and 103 as illustrated in FIG. 9. These hand operated fork lifts are supported in part by heavy metal wheels which are positioned beneath the individual forks 101, 103. Two of these wheels 105, 107 are illustrated in FIG. 9 and support the fork 101.

When the forks 101, 103 approach one of the cross members, such as a cross member 92 illustrated in FIG. 9, the wheels 105, 107 abruptly contact the leading edge of the cross member 92. If this leading edge is abrupt, the force of the wheels 105, 107 on the cross member 92 is concentrated in such a manner that it tends to crush the cross member 92. In order to resist this crushing tendency, the cross members 90, 92, 94 of the present invention are constructed with a high degree of structural rigidity and also provided with a leading edge which is specially contoured to accommodate the hand operated fork lifts. This construction and contour is best illustrated in FIGS. 7 and 8, respectively.

Figure 4:
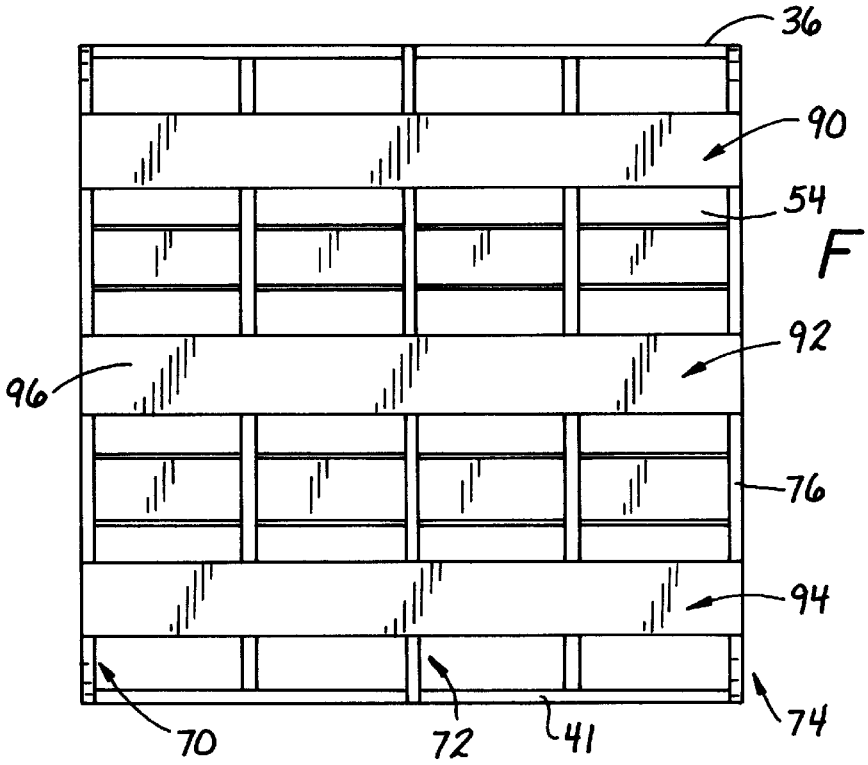
FIG. 4 is a bottom view of the pallet illustrated in FIG. 1.
Figure 7:
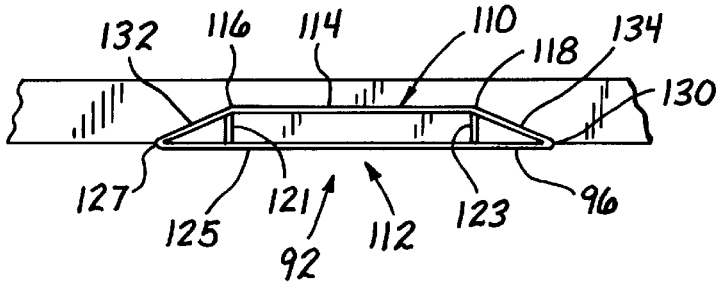
FIG. 7 is a cross section view taken along line 7—7 of FIG. 4 and illustrating a cross member associated with the present invention.

In the embodiment in FIG. 7, the cross member 92 is illustrated to include two longitudinal members 110 and 112 which extend between the support assemblies 70, 74 as illustrated in the bottom view of FIG. 4. The first longitudinal member 110 has a top wall 114 which extends longitudinally between edges 116 and 118 which define its width. Side walls 121 and 123 extend generally perpendicular to the top wall 114 from the respective edges 116 and 118. Thus, the first member 110 is generally U-shaped in cross section and the walls 114, 121 and 123 define a longitudinal channel 125 with an opening 127 which faces away from the top wall 114. In the manner illustrated in FIG. 7, the first member 110 is inverted so that the opening 127 faces away from the top section 27 (FIG. 1) and toward the bottom surface 96.

The second member 112 of the cross member 92 is similar to the first member 110 in that it includes a major wall and two side walls. More specifically, the second member 112 includes a bottom wall 125 which extends longitudinally between opposing edges 127 and 130 which define its width. Side walls 132 and 134 are coupled to the bottom wall 125 at the respective edges 127 and 130. The width of the bottom wall 125 can be critical for a particular conveyor system. For example, a conveyor system common to the food industry includes two-inch rollers on six-inch centers. In such a system, the bottom wall 125 is preferably 5 ¼" wide.

Figure 8:
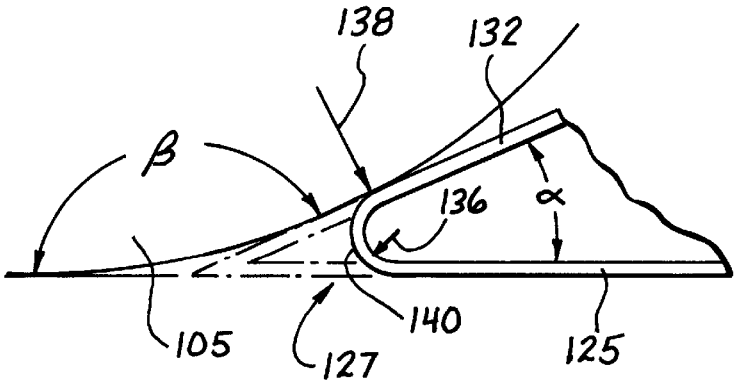
FIG. 8 is an enlarged cross section view showing a radius of curvature at the junction between bottom wall and a side wall of the cross member.
Figure 10:
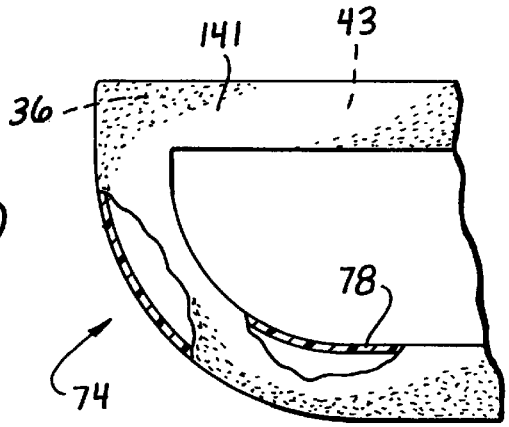
FIG. 10 is an enlarged view of a corner of the pallet illustrating a high friction coating on the frame of the pallet, and also showing the skeletal configuration of the pallet with the coating.

The side walls 132, 134 form an acute angle a with the bottom wall 125 as illustrated in FIG. 8. Thus, the side walls 132, 134 each extend over a portion of the bottom wall 125 and importantly present inclined exterior surfaces 136, 138, respectively, which has an obtuse angle β with respect to the bottom surface 96. When the pallet 21 is disposed on the supporting surface 25, this obtuse angle β insures that the side walls 132, 134 function as inclined planes thereby avoiding an abrupt contact between the wheels 105, 107 and the cross member 90, 92, 94.

In a manner similar to that discussed with reference to the first member 110, the walls 125, 132 and 134 of the second member 112 also form a longitudinal channel having an opening 138 which faces away from the bottom wall 125. The cross member 92 is preferably oriented with this opening 138 facing away from the bottom surface 96 and toward the top section 27 (FIG. 1).

In a preferred embodiment, the first member 110 is inverted and nested in the second member 112. In the manner illustrated in FIG. 7, the walls 125, 132 and 134 of the second member 112 combine with the wall 114 of the first member 110 to form the outer contour of the cross member 92. The side walls 121 and 123 are disposed inwardly of this outer contour. In the embodiment, the side walls 121, 123 of the first member 110 are disposed generally perpendicular to the bottom wall 125 of the second member 112. This orientation of the side walls 121, 123 also provides a high degree of resistance to crushing. In the illustrated embodiment, two longitudinal welds are provided along the length of the cross member 92 at each of the edges 116 and 118. These welds effectively join the walls 132, 121 and 114 at the edge 116 and effectively join the walls 114, 123 and 134 at the edge 118.

In a preferred embodiment, the bottom wall 125 and side walls 132, 134 are formed as a single piece bent back on itself to form the side walls 132, 134. In this case, the bend between the bottom wall 125 and side wall 132 defines the edge 127 which is advantageously provided with a radius of curvature 136 best illustrated in FIG. 8. The radius of curvature 136 is highly advantageous as it provides the cross member 92 with a contour which further resists crushing by the wheels 105, 107 of the fork lift. If the bottom wall 125 and a side wall 132 were joined at a point, as illustrated by the dotted lines in FIG. 8, the wheel 105 of the fork lift would not contact the edge 127 but rather would directly contact the side wall 132, for example, at the point illustrated by an arrow 138 in FIG. 8. By providing the edge 127 with the radius of curvature 136, a transition wall 140 is formed at the edge 127, importantly at the point of contact with the wheel 105, as illustrated by the arrow 138. This transition wall 140 is oriented generally parallel to the arrow 138 and therefore provides substantial resistance to any crushing forces directed along the arrow 138. Thus, the wheel 105 approaches the cross member 92 where its initial contact is opposed by the transition wall 140 having the radius of curvature 136. Once the initial contacting force is opposed, the wheel 105 can then be moved up the incline provided by the side wall 132 and over the cross member 92.

Figure 11:
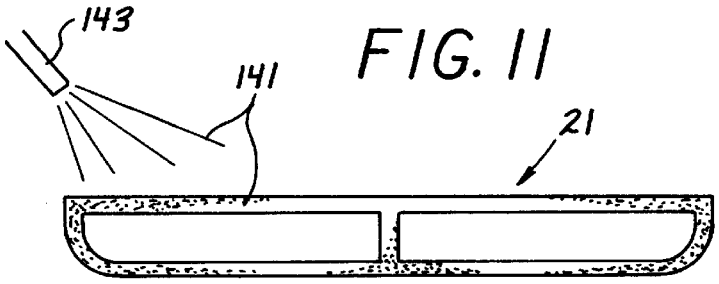
FIG. 11 illustrates a method step whereby the coating is applied to the pallet by using a spray gun.

As illustrated in FIG. 9, the pallet 21 can be provided with various coatings to enhance its longevity and also to facilitate its function with the load 23 and various supporting surfaces 25. For example, a coating 141 can be provided to facilitate a gripping relationship between the load 23 and the pallet 21. This coating 141 may include polymer or any other material which increases the coefficient of friction between the load 23 and the pallet 21. This higher coefficient of friction will help reduce any tendency of the load 23 to slide off of the pallet 21. This advantage can be achieved by applying the coating 141 only to the top surface 32. However, it may be of further advantage to coat the entire pallet 21 and thereby increase its longevity. Thus, the coating 141 could be applied over all surfaces of the pallet 21 in order to inhibit corrosion or to form a surface more resistant to the rough handling commonly associated with pallets. The coating 141 might be applied by dipping or brushing; however, in a preferred method, the coating 141 is applied by use of a spray gun 143 as illustrated in FIG. 11.

There are many variations on the foregoing features which have been described with reference to certain preferred embodiments. It will be noted, for example, that the support assemblies 70, 72, 74 can be provided with a variety of different configurations in order to form a supporting truss. A resulting truss configuration advantageously maintains the pre-load in the top section 27 or alternatively accommodates its own pre-load to maximize the load carrying capacity of the pallet 21.

Forming these support assemblies 70, 72, 74 with an inclined leading edge enables these assemblies to function as skis and thereby facilitates their operation with irregular supporting surfaces 25 and various roller assemblies. Although, this inclined leading edge is circular in the illustrated embodiment, it will be apparent that other arcuate configurations and inclined planar surfaces can also facilitate the ski function of the support assemblies 70, 72, 74.

The provision of cross members 90, 92, 94, of course, adds to the structural rigidity of the pallet 21. These cross members 90, 92, 94 can be provided with many varied shapes and structural configurations in order to resist crushing by a hand operated fork lift, for example. Providing an inclined ramp on the leading edge and introducing that ramp by way of the transition wall 140 offers significant rigidity which might be advantageously retained in other design configurations.

Many different coatings can also be applied to the pallet to facilitate its function with the load 23 and also increase the longevity of the pallet 21. A coating providing a high coefficient of friction with the load 23 will inhibit sliding of the load 23 on the top section 27. Such high friction coatings can be applied by spraying or other methods well known in the art. Although this coating might be limited to the top surface 32, it might also be advantageously applied to all surfaces of the pallet 21 in order to inhibit physical damage and corrosion.

With these comments directed to but a few of the possible variations on the foregoing preferred embodiments, one is cautioned not to limit the concept merely to the embodiments described and illustrated, but rather, encouraged to determine the scope of the invention only with reference to the following claims.

I claim:

1. A pallet for being placed on a supporting surface and for maintaining a load at a pre-selected height above the supporting surface, comprising:

a top section having a first major surface adapted to receive the load and a second major surface, the top section being stressed to provide the pallet with a pre-load;

a bottom section connected to the top section and extending between the second major surface of the top section and a supporting surface;

a plurality of substantially parallel trusses included in the bottom section, at least one of the trusses being stressed to provide the at least one truss with a pre-load;

the bottom section having a third major surface adapted to contact the supporting surface, the third major surface being generally parallel to the first major of the top section;

at least one cross member disposed generally transverse to each of the trusses and extending along the third major surface of the bottom section;

a first member included in the cross member and disposed to extend along the third major surface, the first member having first portions defining a first channel; and a second member included in the cross member and having second portions defining a second channel, the second member being disposed in the first channel of the first member with the second channel of the second member inverted with respect of the first channel of the first member.

2. A pallet for maintaining a load at a predetermined height above a supporting surface, comprising:

a top section having a first major surface adapted to receive the load and a second major surface opposing the first major surface;

a bottom section connected to the top section and extending from the second major surface of the top section;

a plurality of support assemblies included in the bottom section, at least one of the support assemblies being formed of tubular steel; and at least one cross member interconnecting the support assemblies of the bottom section and including a first member with a first opening defining a first channel which comprises a first volume and which faces the top section, and a second member with a second opening defining a second channel which comprises a second volume and which faces away from the top section, whereby the first volume and the second volume intersect.

3. The pallet recited in claim 2 wherein the first member of the cross member includes:

a bottom wall extending longitudinally between a first edge and a second edge of the bottom wall;

at least one side wall extending from the first edge of the bottom wall at an acute angle to the bottom wall; and the bottom wall and the at least one side wall defining the first channel of the first member.

4. The pallet recited in claim 3 wherein:

the bottom wall has a width and the side wall is connected to the bottom wall along a curve having in cross section a radius of curvature and the ratio of the radius of curvature to the width of the bottom wall is not less than about 1/20.

5. The pallet recited in claim 3 wherein the side wall is a first side wall, and the first member further comprises:

a second side wall extending from the second edge of the bottom wall at an acute angle to the bottom wall; and the bottom wall, first side wall and second side wall form a channel with an opening facing toward the top section of the pallet.

6. The pallet recited in claim 2 further comprising a coating disposed to cover the pallet, the coating including a material having a coefficient of friction with a load which is higher than the coefficient of friction between the tubular steel and the load.

7. The pallet recited in claim 2 wherein the top section is stressed to provide the top section with a pre-load, and the support assemblies of the bottom section form trusses which maintain at least a portion of the pre-load in the top section.

8. A pallet adapted to be placed on a supporting surface for maintaining a load at a pre-selected height above the supporting surface, comprising:

a top section having a first major surface adapted to receive the load and a second major surface, the top section being stressed to provide the pallet with a pre-load;

a bottom section connected to the top section and extending between the second major surface of the top section and a supporting surface;

a plurality of trusses included in the bottom section, at least one of the trusses being stressed to provide the bottom section with a pre-load;

at least one cross member disposed generally transverse to each of the plurality of trusses and extending generally along a third major surface of the bottom section;

a first member included in the cross member and disposed to extend along the third major surface, the first member having first portions defining a first channel; and a second member included in the cross member and having second portions defining a second channel, the second member being disposed in the first channel of the first member with the second channel of the second member inverted with respect of the first channel of the first member.

9. A pallet for maintaining a load at a predetermined height above a supporting surface, comprising:

a top section having a first major surface adapted to receive the load and a second major surface opposing the first major surface;

a bottom section connected to the top section and extending from the second major surface of the top section;

a plurality of support assemblies included in the bottom section;

at least one cross member interconnecting the support assemblies of the bottom section and including a first member with a first opening defining a first channel facing the top section and a second member forming a second channel with a second opening facing away from the top section; and the first member of the cross member including:

a bottom wall extending longitudinally between a first edge and a second edge of the bottom wall;

at least one side wall extending from the first edge of the bottom wall at an acute angle to the bottom wall; and the bottom wall and the at least one side wall defining the first channel of the first member.

* * * * *